US009267299B2

(12) United States Patent
Walsh et al.

(10) Patent No.: US 9,267,299 B2
(45) Date of Patent: Feb. 23, 2016

(54) POOL FILTER SYSTEMS INCLUDING POOL JET FITTINGS

(75) Inventors: Sean Walsh, Westhampton, NY (US); James Patrick Mulhern, Nanticoke, PA (US)

(73) Assignee: Eco-Blu Pool Components LLC, Forty Fort, PA (US)

( * ) Notice: Subject to any disclaimer, the term of this patent is extended or adjusted under 35 U.S.C. 154(b) by 651 days.

(21) Appl. No.: 13/197,426

(22) Filed: Aug. 3, 2011

(65) Prior Publication Data

US 2013/0031711 A1 Feb. 7, 2013

(51) Int. Cl.

| | |
|---|---|
| ***A61H 33/00*** | (2006.01) |
| ***E04H 4/12*** | (2006.01) |
| ***E04H 4/16*** | (2006.01) |

(52) U.S. Cl.

CPC ..... *E04H 4/1209* (2013.01); *A61H 33/6052* (2013.01); *E04H 4/169* (2013.01)

(58) Field of Classification Search

CPC ..... A61H 33/6063; A61H 33/6052
USPC ..... 4/492, 541.6; 137/849; 222/490; 239/602

See application file for complete search history.

(56) References Cited

U.S. PATENT DOCUMENTS

| | | | | |
|---|---|---|---|---|
| 2,822,819 | A | 2/1958 | Geeraert | |
| 3,895,646 | A * | 7/1975 | Howat | 137/468 |
| 4,188,673 | A | 2/1980 | Carter | |
| 4,393,526 | A | 7/1983 | Miller et al. | |
| 5,245,714 | A * | 9/1993 | Haraga et al. | 4/541.2 |
| 5,265,286 | A * | 11/1993 | Filipponi | 4/541.6 |
| 5,495,627 | A | 3/1996 | Leaverton et al. | |
| 7,445,028 | B1 | 11/2008 | Aanonsen et al. | |
| 7,571,496 | B2 | 8/2009 | Martin | |
| 7,874,808 | B2 | 1/2011 | Stiles | |
| 8,322,908 | B1 | 12/2012 | Hartmann | |
| 2013/0061383 | A1 | 3/2013 | Hartmann et al. | |

OTHER PUBLICATIONS

MrAllsurface. "The Miracle Circulator Pool jet Return," You Tube Video [online], Oct. 27, 2009. [retrieved on Oct. 8, 2012]. Retrieved from the Internet: <URL: http://www.houtube.com/watch?v=v2omwnVejx0>. Entire video.

http//www.infusionpool.com/Product; 2 pages; 2011.

* cited by examiner

*Primary Examiner* — Janie Christiansen
(74) *Attorney, Agent, or Firm* — Baker & Hostetler LLP

(57) ABSTRACT

Disclosed is a pool jet fitting configured to direct flow of water in a closed loop pool pumping filtration system. The pool jet fitting may include a housing, and a valve positioned in the housing. The housing may include a housing body that defines a bore that extends through the housing body. The housing body may include a coupler that is configured to mate with a coupler of a wall mount so as to releasably couple the housing to the wall mount. The valve may be positioned in the bore of the housing and may be configured to receive water flow from a water pump. The valve may define an adjustable opening having a dimension capable of automatically adjusting between a first dimension and a second dimension to facilitate a predetermined outflow velocity of the water received from the pump.

29 Claims, 14 Drawing Sheets

POOL FILTER SYSTEMS INCLUDING POOL JET FITTINGS

BACKGROUND

Swimming pools include pool filter systems that circulate the pool water so as to remove debris, and to prevent algae outbreaks and pH swings. Typically pool filter systems include a pool pump that draws the pool water from the pool through a drain/filter and back to the pool through a plurality of returns. Many returns take the form of jet fittings, each having a rotatable eyeball that directs the return flow of the pool water toward the surface of the pool. Such an orientation creates surface agitation to thereby force the debris to the filter, and to create an audible sound that is desired by the pool owner.

Pool pumps typically are operated several hours of the day at high speeds, and consume a large amount of energy. The energy consumption involved during such usage can account for a major portion of a home owner's energy costs. To address this problem, variable speed water pumps have been introduced that can operate at low speeds. When operating at low speeds, however, the desired effect of the surface agitation is lost.

SUMMARY

In one embodiment a pool jet fitting may be configured to direct flow of water in a closed loop pool pumping filtration system. The pool jet fitting may include a housing, and a valve positioned in the housing. The housing may include a housing body that defines a bore that extends through the housing body. The housing body may include a coupler that is configured to mate with a coupler of a wall mount so as to releasably couple the housing to the wall mount. The valve may be positioned in the bore of the housing and may be configured to receive water flow from a water pump. The valve may define an adjustable opening having a dimension capable of automatically adjusting between a first dimension and a second dimension to facilitate a predetermined outflow velocity of the water received from the pump.

In another embodiment the pool jet fitting may include a housing and a valve positioned in the housing. The housing may include a housing body that defines a bore that extends through the housing body. The housing body may be configured to mate with a pre-existing wall mount, and the bore may be configured to receive water flow from a variable flow water pump that is capable of pumping the water flow at different flow rates. The valve may be positioned in the bore of the housing, and may define an adjustable opening that is configured to maintain an outflow velocity of the water that agitates the surface of a pool as the flow rate of the water flow from the variable speed water pump changes.

In another embodiment, the pool jet fitting includes a housing and a valve. The housing includes a housing body and a bore that extends through the housing body. The housing body includes a coupler that is configured to mate with a coupler of a wall mount so as to releasably couple the housing to the wall mount. The bore is configured to receive water flow from a water pump. The valve is positioned in the bore of the housing. The valve has at least one slit that defines at least two flexible members that are configured to flex outwardly so as to facilitate a predetermined outflow velocity of the water received from the water pump.

In another embodiment a pool filter system may be configured to promote surface agitation of a pool. The pool filter system may include a variable speed water pump, a plurality of pool jet fittings, a pool drain, and piping. The water pump may be configured to pump water at least at a first flow rate and a second flow rate that is greater than the first flow rate. The variable speed water pump may have a pump inlet and a pump outlet. Each one of the plurality of pool jet fittings may include a valve that defines an adjustable opening that automatically adjusts in response to a change in pump output from the second flow rate to the first flow rate to facilitate an outflow velocity of the water from the pool jet fitting to promote surface agitation of a pool. The piping may connect the pool drain to the pump inlet and may connect the pump outlet to the pool jet fittings.

BRIEF DESCRIPTION OF THE DRAWINGS

The foregoing summary, as well as the following detailed description of a preferred embodiment of the application, will be better understood when read in conjunction with the appended drawings. For the purposes of illustrating the pool filter systems and pool jet fittings of the present application, there is shown in the drawings preferred embodiments. It should be understood, however, that the application is not limited to the precise arrangements and instrumentalities shown. In the drawings.

DETAILED DESCRIPTION

Figure 1A:
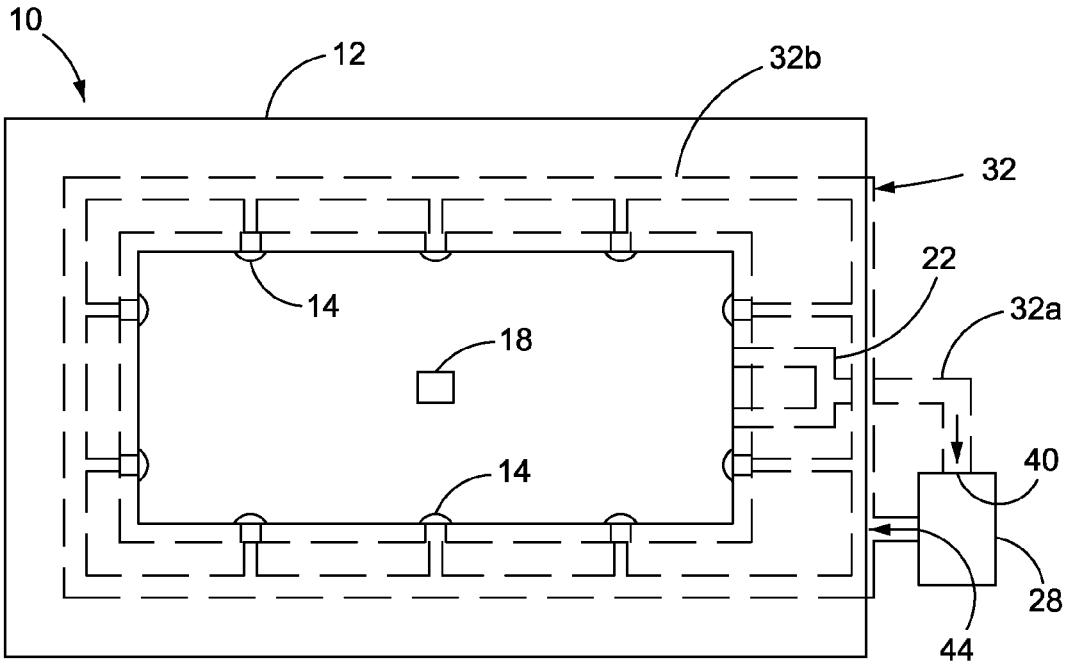
FIG. 1A is a schematic of a pool filter system including a pump, and a plurality of pool jet fittings that are configured to receive water from the pump and direct the water into the pool so as to agitate the surface of the pool.
Figure 1B:
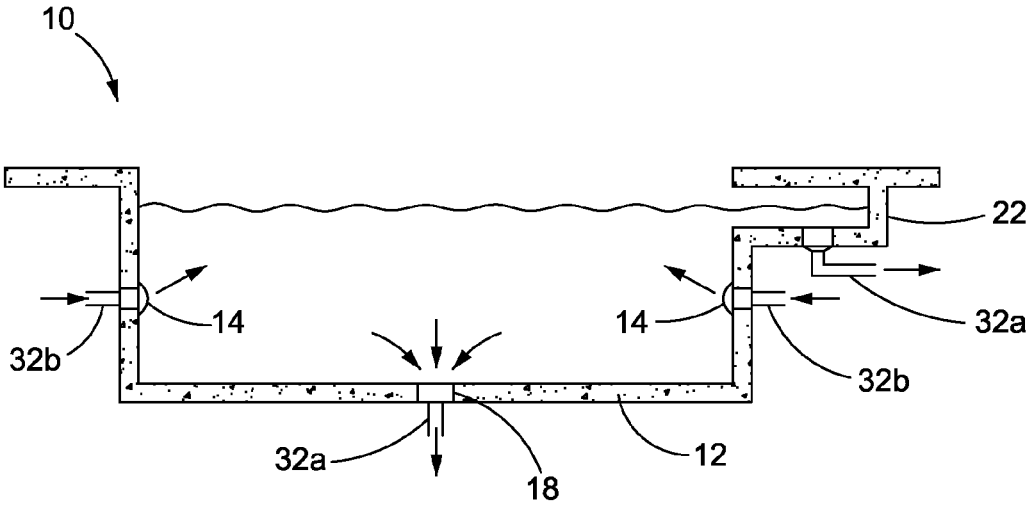
FIG. 1B is a schematic showing the flow of water through the pool filter system shown in FIG. 1A.

Referring to FIGS. 1A and 1B, a pool filter system 10 is configured to filter water of a pool 12 in an efficient and economical manner while at the same time maintaining the desired surface agitation of the pool 12. The pool filter system 10 includes a plurality of pool jet fittings 14 mounted to at least one, such as four walls of the pool 12, a pool drain 18 mounted to a floor of the pool 12, a pool filter 22 disposed along an upper portion of one of the walls of the pool 12, and a water pump 28 that is configured to receive water from the pool filter 22 and/or the pool drain 18, and subsequently return the water to the pool 12 through the pool jet fittings 14. As shown in FIG. 1A, the pool filter system 10 further includes piping 32 that operatively connects each of the pool jet fittings 14, the pool drain 18, and the pool filter 22 to the water pump 28.

The pool filter system 10 may be configured to filter water for any pool configuration as desired. For example, the pool filter system 10 may filter water through a pool 12 that is substantially square shaped as illustrated or through an alternatively shaped pool, such as a kidney shaped pool. The pool filter system 10 may be configured to filter or otherwise pump water through a pool 12 that is configured as a swimming pool as illustrated, or any other pool as desired, such as a hot tub or a Jacuzzi bathtub. The pool filter system 10 may include any number of pool jet fittings 14. For example, while the illustrated embodiment of the pool filter system 10 includes ten pool jet fittings 14, it should be understood that the pool filter system 10 may include a single pool jet fitting 14 up to any number of pool jet fittings 14 depending on the size of the pool 12.

The water pump 28 may be a variable speed water pump that is configured to pump the water at least at a first flow rate and at a second flow rate that is greater than the first flow rate. By having multiple flow rates, the water pump 28 may be set to operate at a lower speed (i.e. lower flow rate) and therefore reduce energy use as compared to a single speed water pump that always operates at a high speed. For example, the water pump may operate at a first flow rate of about 20 gallons/minute and at a second flow rate of about 130 gallons/minute. It should be understood, however, that the water pump 28 may be configured to pump water at any desired flow rate(s). As shown in FIG. 1A, the water pump 28 includes a pump inlet 40 and a pump outlet 44. The pump inlet 40 is connected to the pool drain 18 and to the pool filter 22 by piping 32*a*, and the pump outlet 44 is connected to the pool jet fittings 14 by piping 32*b*. The pump 28 may be supplied with or otherwise suck in water from the pool 12 through the pool drain 18 and the pool filter 22, and then return or otherwise pump the water back to the pool 12 through the pool jet fittings 14. Therefore, the pool filter system 10 may be considered a closed loop pool pumping filtration system.

As shown in FIG. 1B, the pool jet fittings 14 may be mounted to the wall of the pool 12, proximate to, but below the surface of the water. As shown, the pool jet fittings 14 may be configured such that the flow of water through the pool jet fittings 14 is directed to the pool surface to thereby agitate the pool surface. The agitation of the pool surface not only directs any debris found on the pool surface toward the pool filter 22, but it also creates a sound that is often times desired. For example, such a sound may indicate that the pool filter system 10 is operating, and/or may be relaxing.

Figure 2A:
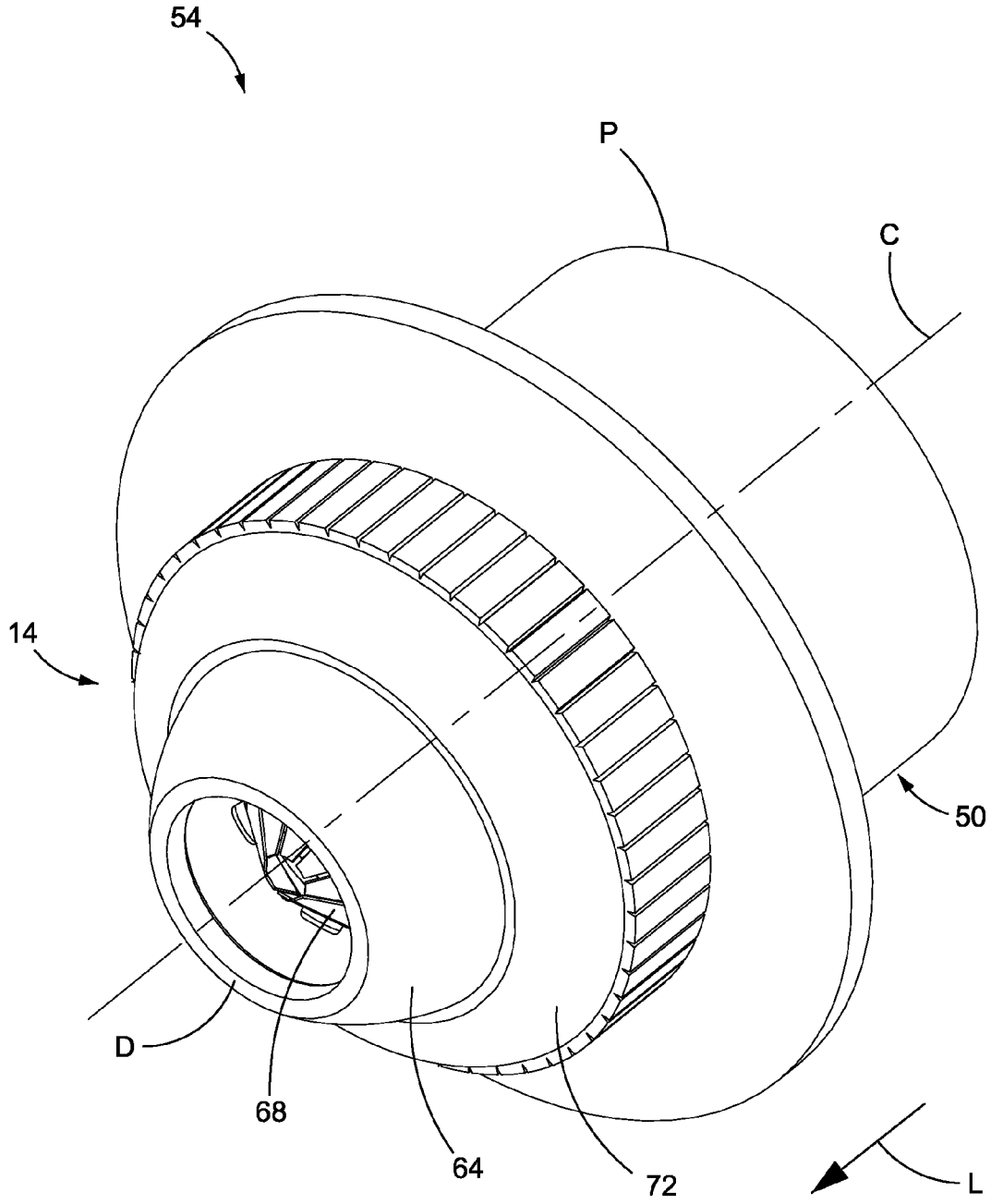
FIG. 2A is a perspective view of a pool jet fitting constructed in accordance with an embodiment, the pool jet fitting coupled to a wall mount that is typically mounted in a wall of a pool.
Figure 2B:
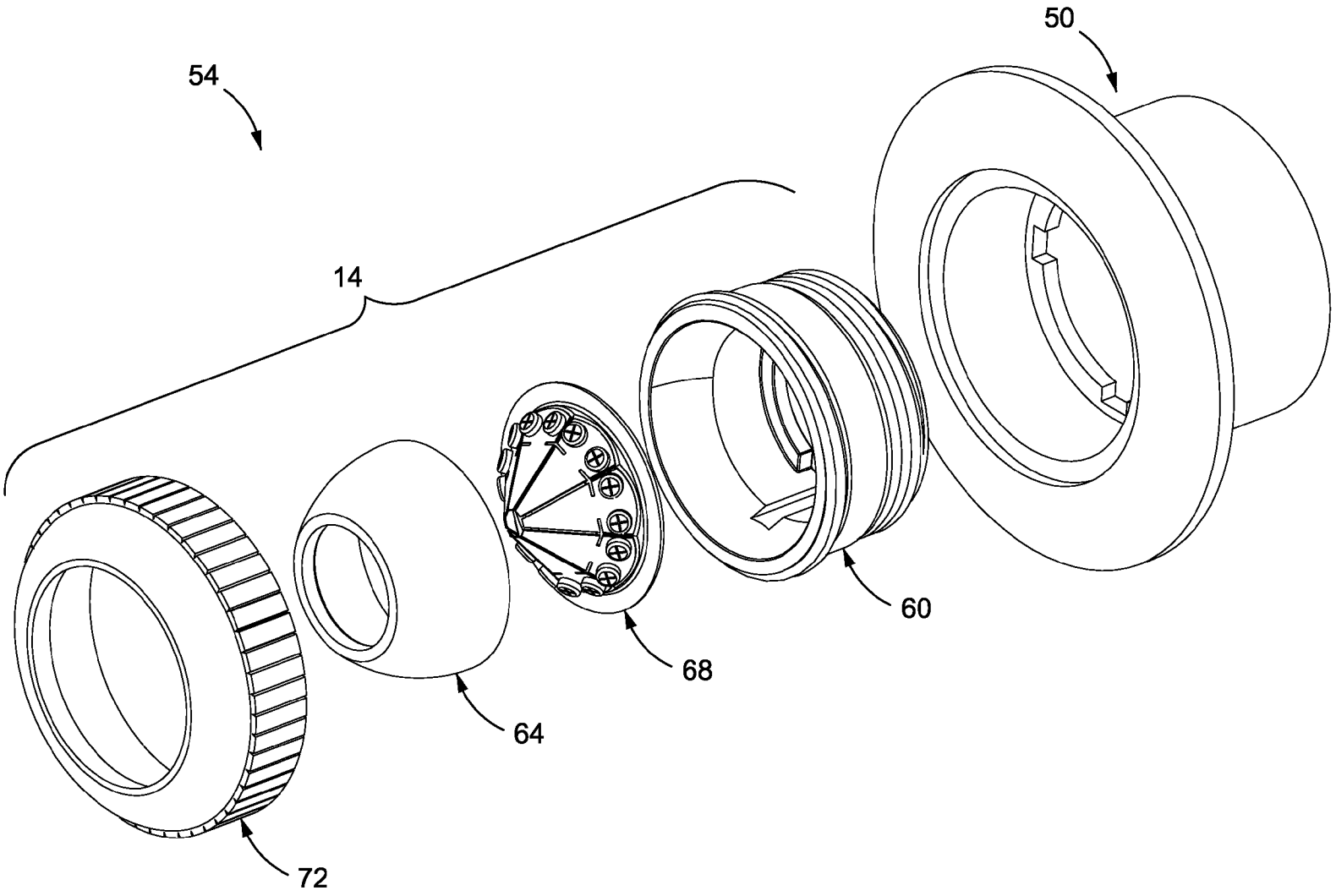
FIG. 2B is a perspective exploded view of the pool jet fitting and wall mount shown in FIG. 1, the pool jet fitting including a valve, a housing, a rotatable insert, and a cap.

Now referring to FIGS. 2A and 2B, each pool jet fitting 14 is configured to be releasably coupled to a respective wall mount 50 that is mounted to a wall of the pool 12. The pool jet fitting 14, and the wall mount 50 together define a pool jet fitting assembly 54. As shown in FIG. 2A, the assembly 54 defines a distal end D, a proximal end P, and a center axis C that extends along a longitudinal direction L between the proximal end P and the distal end D. The pool jet fitting 14 is configured to self-adjust so as to maintain adequate surface agitation of the pool whether the water pump 28 is operating at high speeds or at low speeds. As shown in FIG. 2B, each pool jet fitting 14 includes a housing 60 that is configured to couple to the wall mount 50, a rotatable insert 64 disposed in the housing 60, and a valve 68 mounted within the rotatable insert 64. The rotatable insert 64 is configured to rotate relative to the housing 60 so as to direct the flow of water from the pool jet fitting 14 toward the pool surface. The valve 68 is configured to automatically adjust in response to a change in pump output from the second flow rate to the first flow rate to facilitate an outflow velocity of the water from the pool jet fitting 14 that promotes surface agitation of the pool 12. As shown in FIG. 2B, the pool jet fitting 14 further includes a cap 72 that is coupled to the distal end of the housing 60 to thereby retain the rotatable insert 64 and the valve 68 within the housing 60.

Figure 3A:
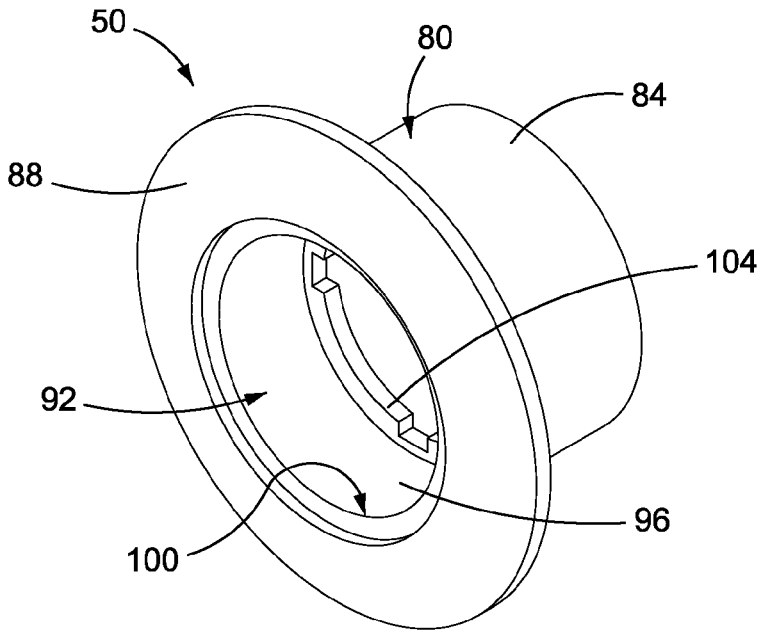
FIG. 3A is a perspective view of the wall mount shown in FIG. 2A.
Figure 3B:
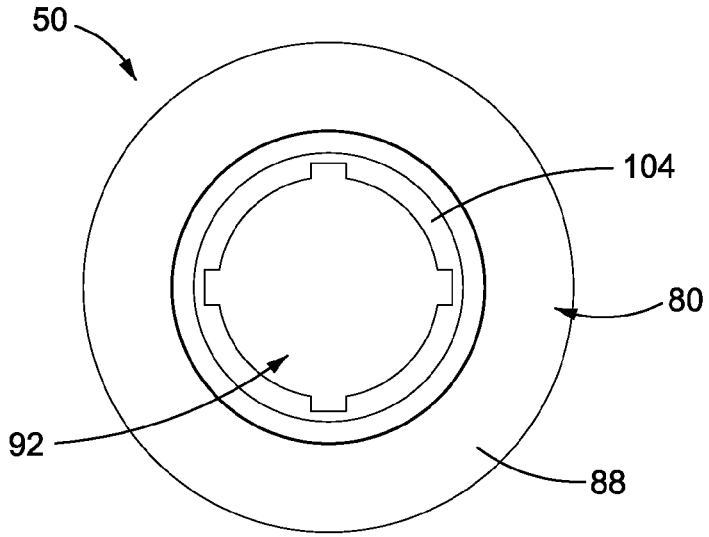
FIG. 3B is a front elevation view of the wall mount shown in FIG. 3A.
Figure 3C:
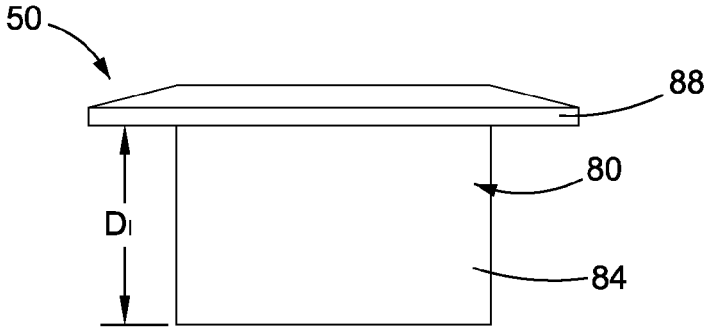
FIG. 3C is a side elevation view of the wall mount shown in FIG. 3A.

Referring to FIGS. 3A-3C, the wall mount 50 may be a pre-existing or standard wall mount already attached to the wall of the pool 12. Therefore, the pool jet fitting 14 may be sized and configured to be coupled to a wall mount 50 of a pre-existing pool. It should be understood, however, that the wall mount 50 may be a standard wall mount to be used in a newly built pool or a new wall mount that is different than the current standard wall mounts. As shown in FIG. 3A, the wall mount 50 includes a wall mount body 80 that defines a tubular portion 84 and a shoulder 88 that extends radially outward from a distal end of the tubular portion 84. The wall mount body 80 further defines a bore 92 that extends through the wall mount body 80 from the proximal end to the distal end of the body 80. The bore 92 is configured to receive water from the water pump 28.

The tubular portion 84 is configured to be glued or otherwise affixed within a bore defined by the wall of the pool 12. As shown in FIG. 3C, the tubular portion 84 has a length $D_1$ that is defined between the proximal end of the tubular portion 84 and an inner surface of the shoulder 88. The length $D_1$ of the tubular portion 84 is between about 1.25 inches and about 1.75 inches, and typically is about 1.5 inches for standard wall mounts 50. When the wall mount 50 is affixed to the pool wall, the tubular portion 84 will extend into the wall until an inner surface of the shoulder 88 abuts the surface of the pool wall.

As shown in FIGS. 3A and 3C, the wall mount 50 further includes a coupler, such as internal threads 96 that extend out from an inner surface 100 of the bore 92 of the wall mount body 80 proximate to a distal end of the wall mount 50. The threads 96 are configured to engage threads of the housing 60 so as to releasably couple the housing 60 to the wall mount 50. It should be understood, however, that the wall mount 50 is not limited to threads 96, and that the wall mount 50 may include any coupler that is capable of releasably coupling the housing 60 to the wall mount 50.

As shown in FIGS. 3A and 3B, the wall mount 50 further includes a lip 104 that extends out from the inner surface 100 of the bore 92 proximal to the threads 96. The lip 104 is configured to act as a stop and prevent over insertion of the housing 60 when the housing 60 is inserted into the bore 92 and coupled to the wall mount 50.

Figure 4A:
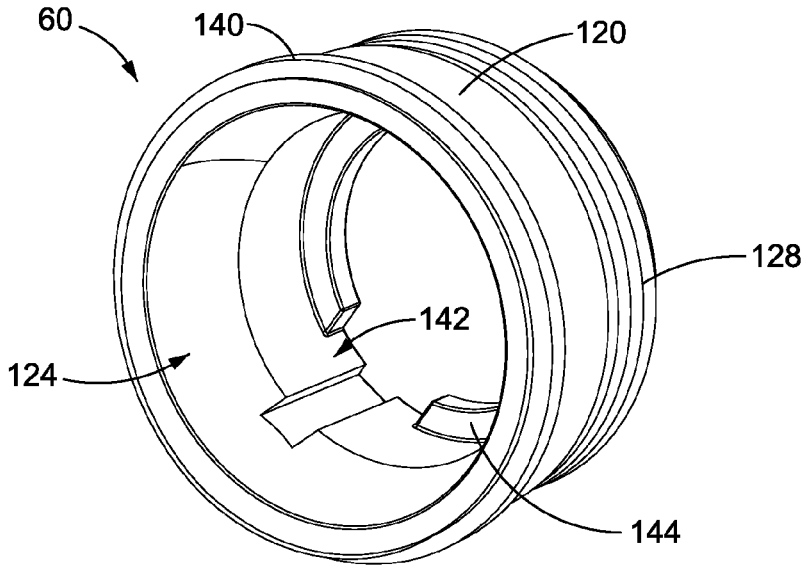
FIG. 4A is a perspective view of the housing shown in FIG. 2A.
Figure 4B:
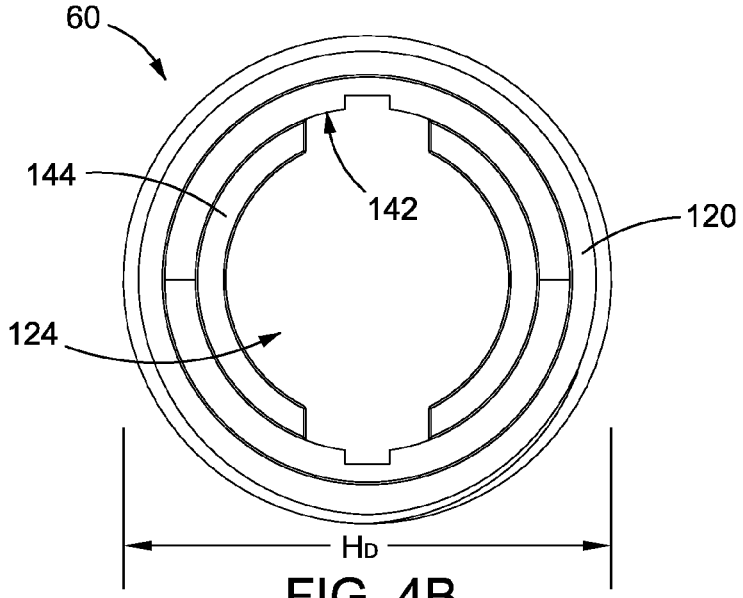
FIG. 4B is a front elevation view of the housing shown in FIG. 4A.
Figure 4C:
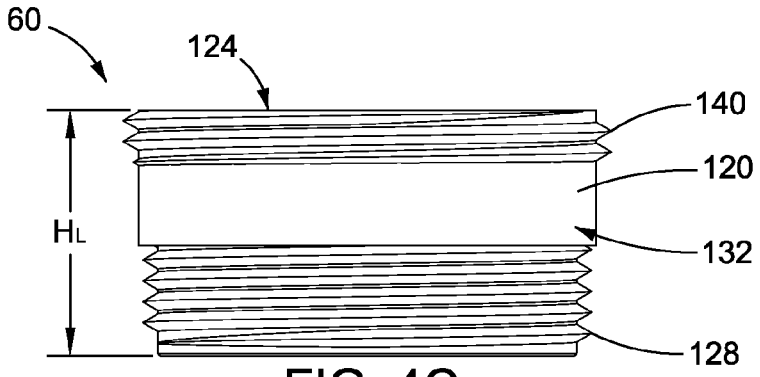
FIG. 4C is a side elevation view of the housing shown in FIG. 4A.

Referring to FIGS. 4A-4C, the housing 60 includes a tubular body 120 that defines a bore 124 that extends longitudinally through the body 120. The tubular body 120 is configured to be releasably coupled to the wall mount 50 such that when coupled, the bore 124 of the housing 60 is in line with or otherwise coaxial with the bore 92 of the wall mount 50. Therefore, like the wall mount 50, the housing 60 is configured to receive the water from the water pump 28. As shown in FIGS. 4B and 4C, the housing 60 is configured to have a longitudinal length $H_1$ that is between about 0.875 inches and about 1.125 inches, and an outer diameter $H_D$ that is between about 1.75 inches and about 2 inches. Typically, a standard housing is configured to have a length $H_1$ of about 1 inch, and a diameter $H_D$ of about 1.875 inches. As shown, the tubular body 120 defines a first coupler, such as external threads 128 that extend out from an external surface 132 of the body 120 proximate to the proximal end of the housing 60. The threads 128 are configured to engage the internal threads 96 of the wall mount 50 to thereby releasably couple the housing 60 to the wall mount 50. In particular the housing 60 is threaded into the bore 92 of the wall mount 50 until the proximal end of the housing 60 abuts the lip 104 within the bore 92. At this point, the housing 60 will be fully coupled to the wall mount 50.

The tubular body 120 further defines a second coupler, such as external threads 140 that extend out from the external surface 132 of the body 120 proximate to the distal end of the housing 60. The threads 140 are configured to engage threads of the cap 72 so as to releasably affix the cap 72 to the distal end of the housing 60. It should be understood, however, that the housing 60 is not limited to threads 128 and 140, and that the housing 60 may include any coupler that is capable of releasably coupling the housing 60 to the wall mount 50 and the cap 72 to the housing 60.

As shown in FIGS. 4A and 4B, the housing 60 further includes a lip 144 that extends out from an inner surface 142 of the bore 124 proximate to the proximal end of the housing 60. The lip 144 is configured to act as a stop and prevent over insertion of the rotatable insert 64 and the valve 68 when the rotatable insert 64 and the valve 68 are placed within the bore 124 of the housing 60. Moreover, when the cap 72 is coupled to the external threads 140 of the housing 60 the rotatable insert 64 and the valve 68 will be locked or otherwise held within the bore 124 of the housing 60 between the cap 72 and the lip 144.

Referring now to FIGS. 2A and 5A-5D, the valve 68 is configured to be positioned within the bore 124 of the housing 60, and defines an adjustable opening 160 that defines a dimension $D_V$ capable of automatically adjusting between a first dimension and a second dimension to facilitate an outflow velocity of the water received from the water pump 28 that agitates the surface of the pool. For example, the adjustable opening 160 is configured to automatically adjust so as to maintain an outflow velocity of the water that agitates the surface of the pool as the flow rate of the water flow from the water pump 28 changes. The dimension $D_V$ of the adjustable opening 160 may be capable of automatically adjusting between a first dimension that is about 0.187 inches, and a second dimension that is about 1 inch. It could also be said that the adjustable opening 160 may be capable of automatically adjusting between a first area that is about 0.027 $in^2$, and a second area that is about 0.785 $in^2$. It should be understood, however, that the first and second dimensions may be any dimension as desired, and the first and second areas may be any area as desired. Moreover, while the dimension $D_V$ is illustrated as a diameter, it should be understood that the dimension $D_V$ may alternatively be a width, or a height.

Figure 5A:
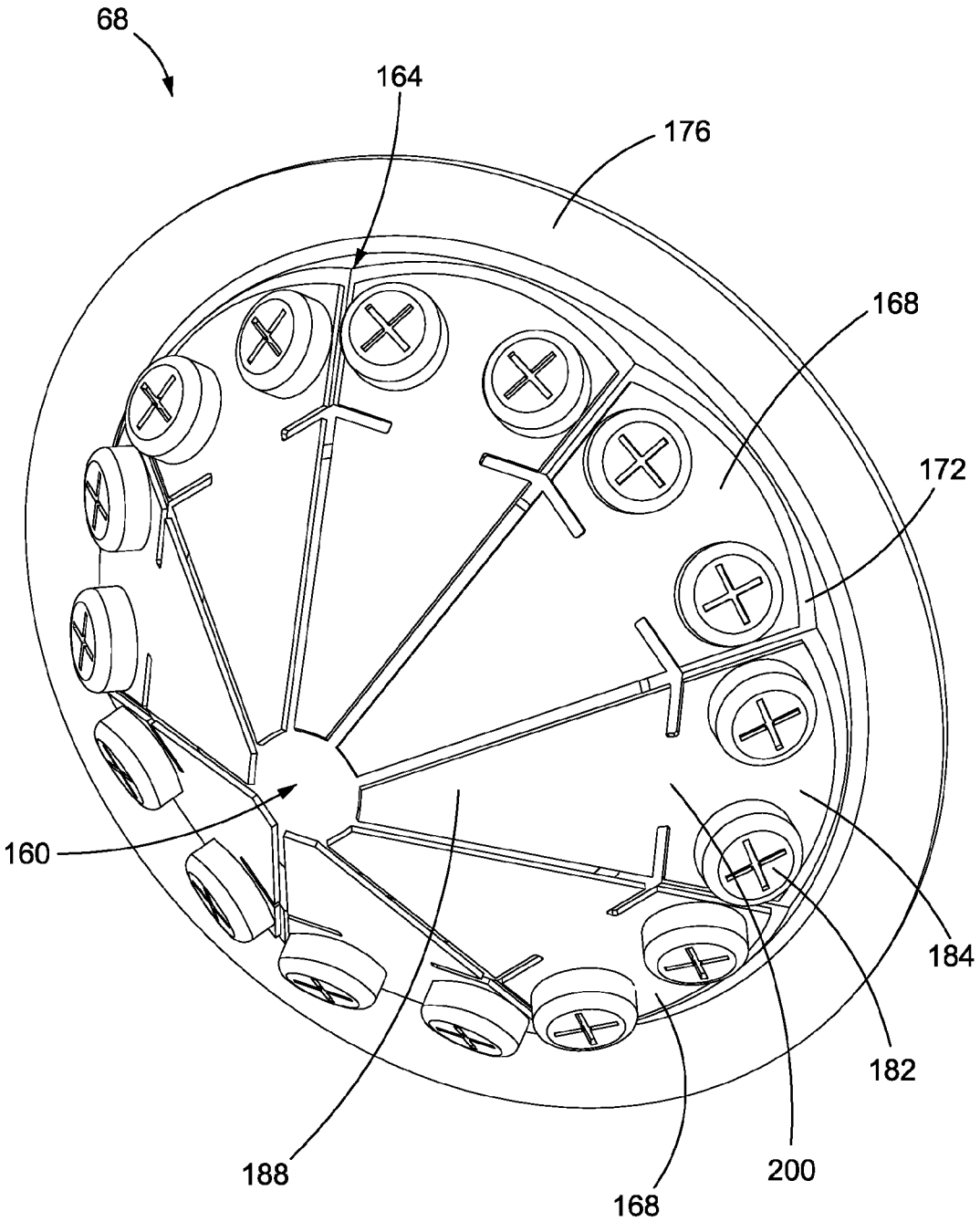
FIG. 5A is a perspective view of the valve shown in FIG. 2A, the valve including a valve body and a plurality of flexible member extending from the valve body.
Figure 5B:
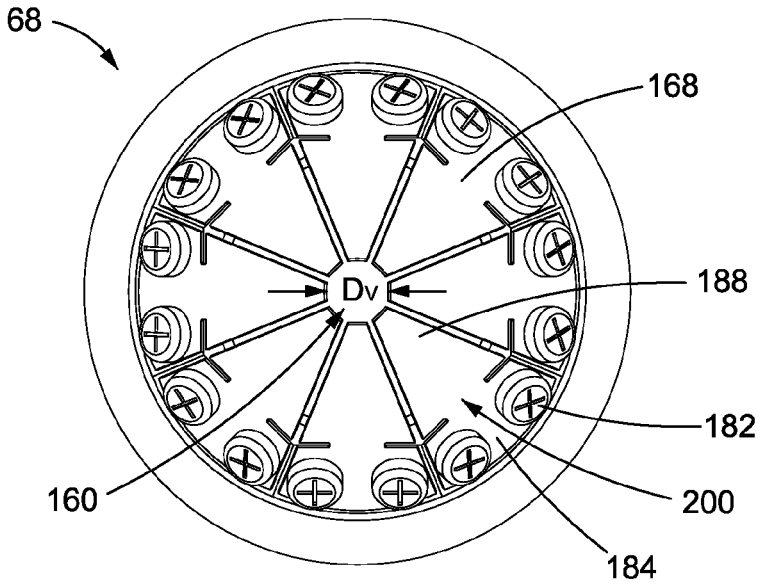
FIG. 5B is a front elevation view of the valve shown in FIG. 5A.
Figure 5C:
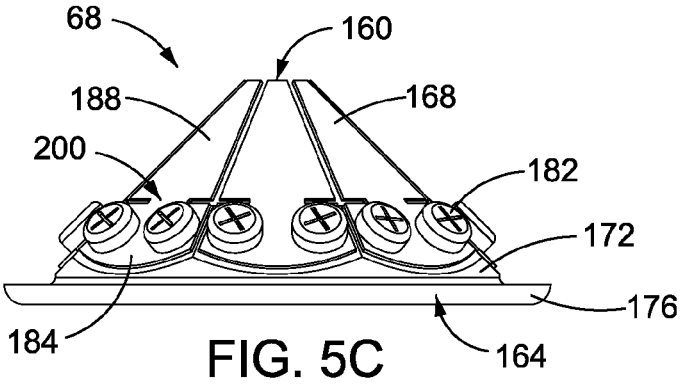
FIG. 5C is a side elevation view of the valve shown in FIG. 5A.
Figure 5D:
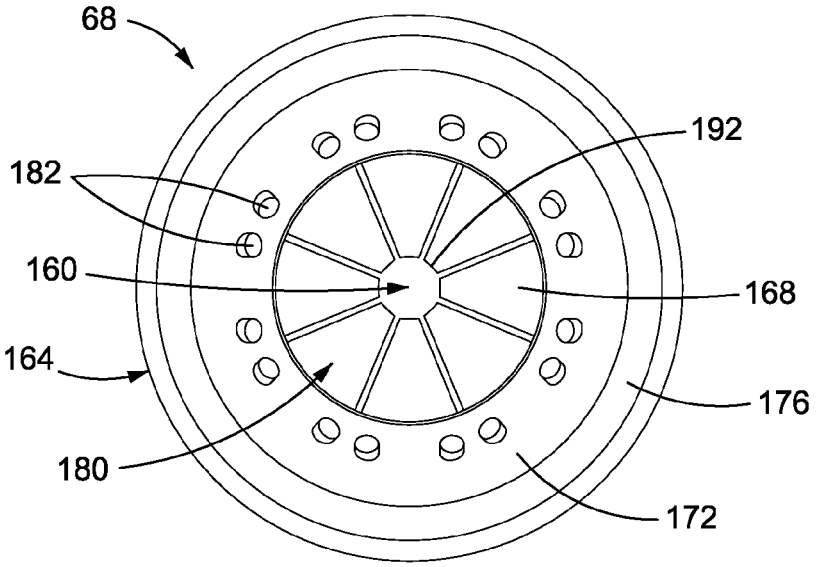
FIG. 5D is a rear elevation view of the valve shown in FIG. 5A.

As shown in FIG. 5A, the valve 68 includes a valve body 164, and a plurality of members 168 that extend distally from the valve body 164. As shown in FIGS. 5B-5D, the valve body 164 defines a member support portion 172, a shoulder 176 that extends radially outward from a proximal end of the member support portion 172, and a bore 180 that extends longitudinally through the body 164. As shown, the member support portion 172 angles toward the center axis of the valve 68 as the member support portion 172 extends distally. Therefore, the bore 180 includes a diameter that decreases as the bore 180 extends distally through the valve body 164. The bore 180 of the valve 68 is configured to receive the water flow from the water pump 28 as it flows through the wall mount 50 and the housing 60, and directs the water flow toward the adjustable opening 160 that in the illustrated embodiment is defined by the members 168.

As shown in FIG. 5D, the shoulder portion 172 which extends radially outward from a proximal end of the member support portion 172 is substantially planar and is configured to be disposed within the bore 124 of the housing 60. In some embodiments, the shoulder portion 172 may be configured to abut against the lip 144 of the housing 60 when the valve 68 is fully inserted within the bore 124 of the housing 60.

As shown in FIGS. 5A-5C, each member 168 lies flush against the member support portion 172 such that the members 168 together define a substantially cone shaped structure. That is, as the members 168 extend distally they extend toward the center axis of the valve 68. The members 168 and the valve body 164 may be formed or otherwise molded as a single unit or the members 168 may be coupled to the valve body 164 with fixation elements 182 as illustrated. In the illustrated embodiment, each member 168 is coupled to the valve body 164 by two fixation elements 182 that define screws.

Figure 6:
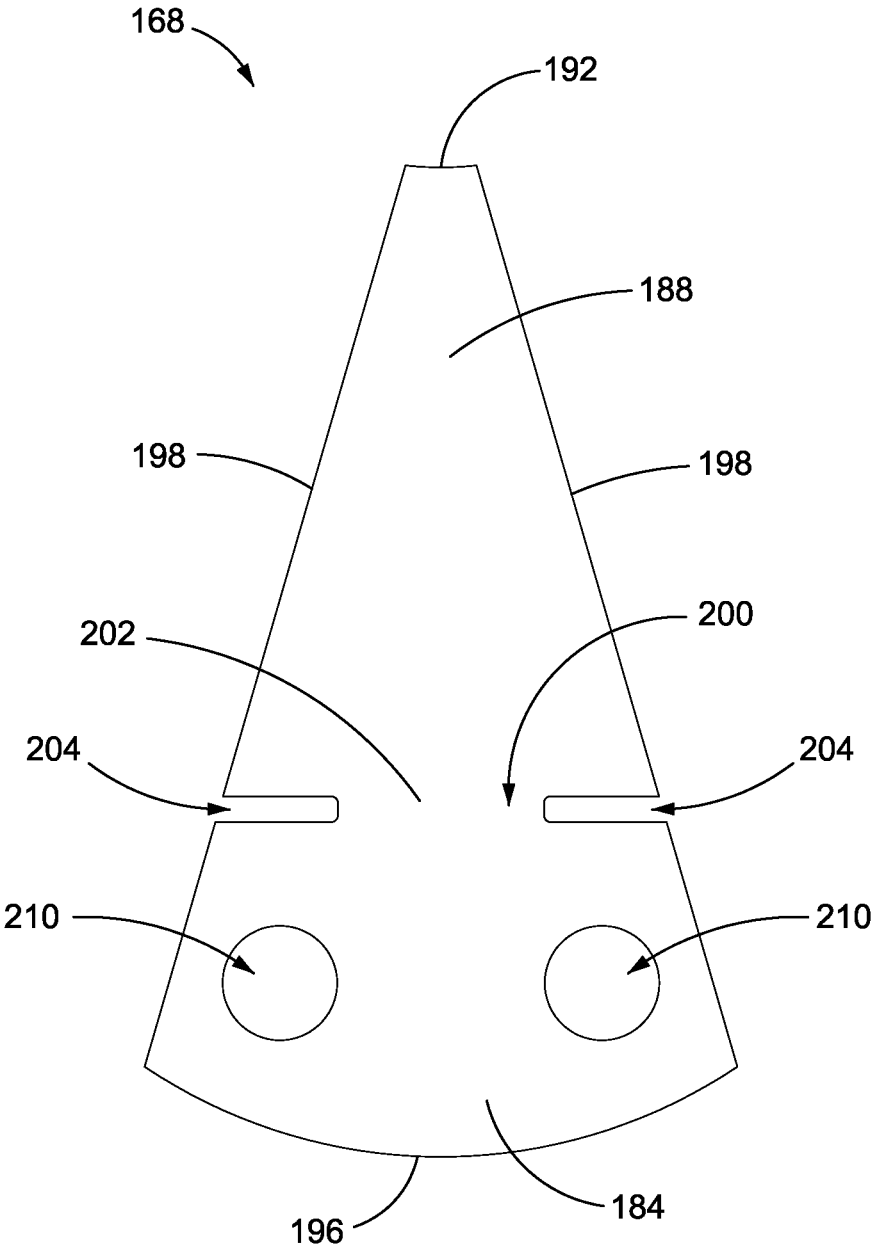
FIG. 6 is a top plan view of one of the plurality of flexible members of the valve shown in FIG. 5A.

As shown in FIG. 6, each member 168 is configured to flex outwardly and includes a coupling portion 184 and a flexing portion 188 that extends distally from the coupling portion 184. Each member 168 is substantially triangular in shape and defines a distal end 192 and a proximal end 196 that is wider than the distal end 192. As shown, the distal end 192 of the member 168 is substantially flat. Therefore, together, the distal ends 192 of all of the members 168 define the adjustable opening 160, which in the illustrated embodiment is circular. Each member 168 further defines outer sides 198 that converge toward each other as they extend distally and terminate at the distal end 192. The members 168 may be made of any material as desired. For example, the members 168 may be made of a plastic material.

As shown in FIG. 6, each coupling portion 184 defines a pair of holes 210 that extend through the coupling portion 184. The holes 210 are configured to receive the fixation elements 182 so as to couple the member 168 to the member support portion 172 of the valve body 164.

As shown in FIG. 6, each member 168 further includes a hinge 200 that connects the flexing portion 188 to the coupling portion 184. The hinge 200 is a weakened portion 202 defined between a pair of slits 204 that allows the flexing portion 188 to flex relative to the coupling portion 184. As shown, the flexing portion 188, the coupling portion 184, and the hinge 200 are integrally formed as a single unit. It should be understood, however, that the hinge 200, the coupling portion 184, and the flexing portion 188 may each define separate units that are combined to form the member 168. It should also be understood, that the hinge 200 may be any portion of the member 168 that allows the flexing portion 188 to flex relative to the coupling portion 184.

Figure 7A:
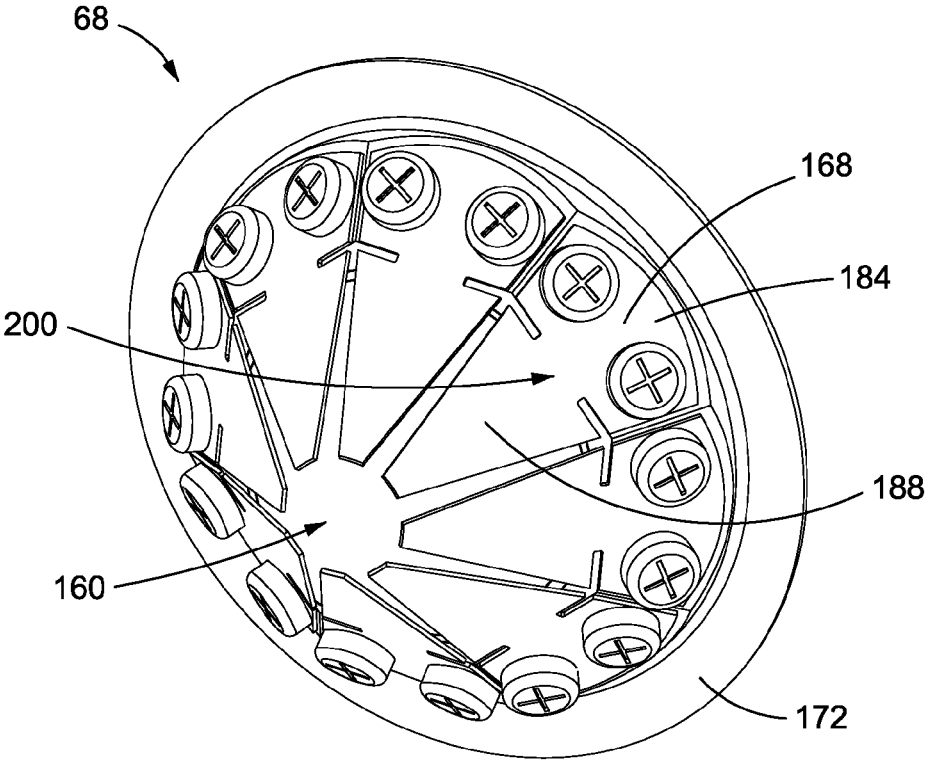
FIG. 7A is a perspective view of the valve shown in FIG. 5A in an expanded position.
Figure 7B:
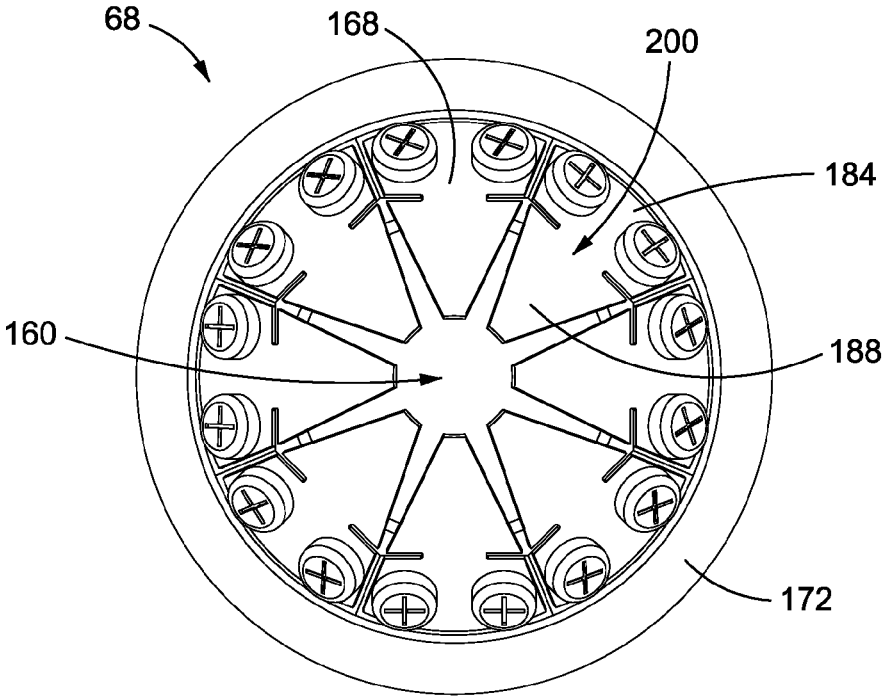
FIG. 7B is a front elevation view of the valve shown in FIG. 7A.

Referring now to FIGS. 7A and 7B, each member 168 is configured to flex, such that when the flow rate of the water from the water pump 28 increases, the members 168 flex outwardly to thereby increase the dimension of the adjustable opening 160. That is, each flexing portion 188 pivots about a respective hinge 200 so as to widen the adjustable opening 160 from a first or initial dimension as shown in FIG. 5B, to a second or expanded dimension as shown in FIG. 7B. Because the valve 68 includes an adjustable opening 160, the valve 68 is configured to maintain a predetermined outflow velocity of water through the pool jet fitting 14 as the flow rate of the water flow from the water pump 28 changes. The predetermined outflow velocity may correspond to a range of velocities having a minimum velocity at which the water flow is visible or otherwise agitates the surface of the pool. For example, the predetermined outflow velocity may have a minimum velocity of 15 ft/s. It should be understood, however, that the predetermined outflow velocity may be any velocity as desired, and may include any minimum velocity as desired. Moreover, the predetermined outflow velocity may depend on a variety of factors, such as the piping, the pump, and the position of the pool jet fitting assemblies.

Figure 8A:
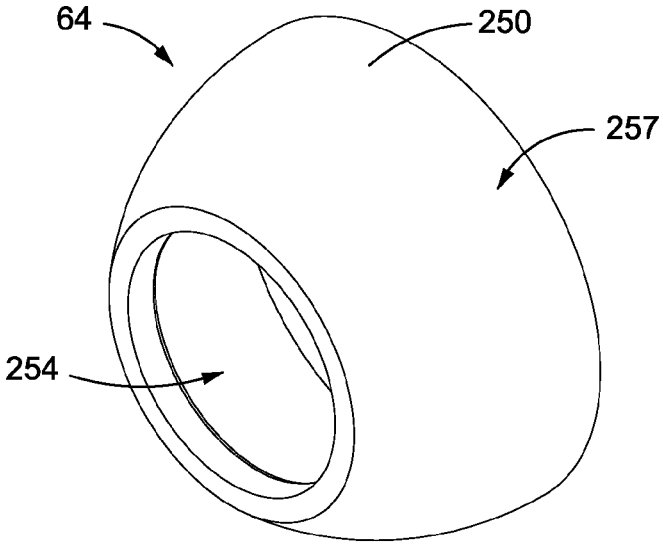
FIG. 8A is a perspective view of the rotatable insert shown in FIG. 2A.
Figure 8B:
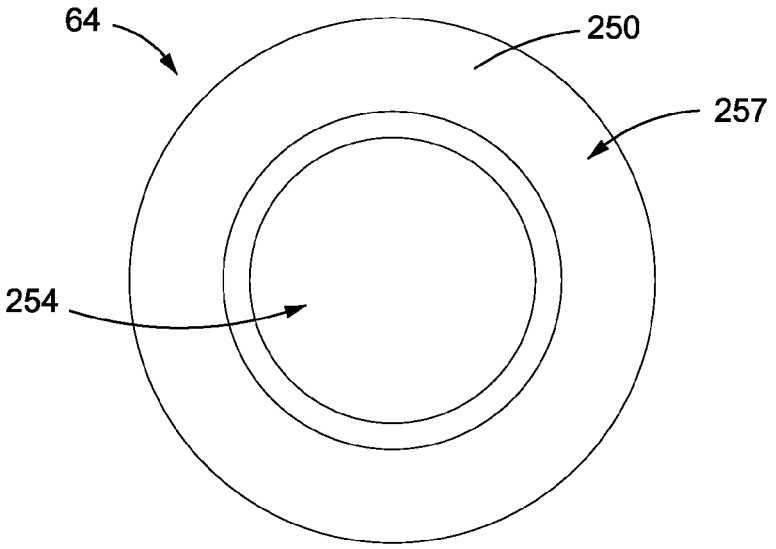
FIG. 8B is a front elevation view of the rotatable insert shown in FIG. 8A.
Figure 8C:
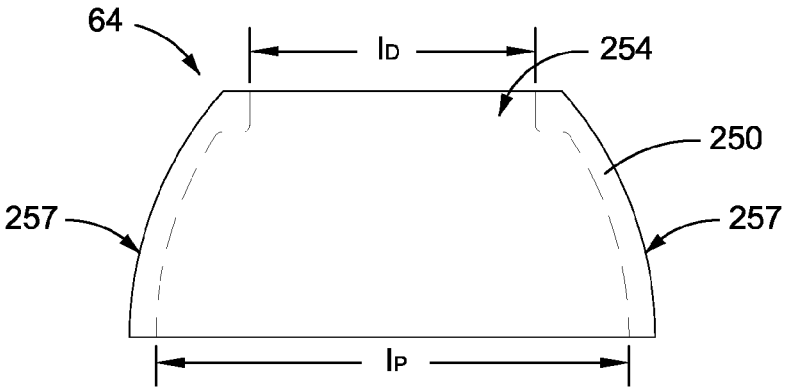
FIG. 8C is a side elevation view of the rotatable insert shown in FIG. 8A.

Referring now to FIGS. 8A-8C, the rotatable insert 64 includes an insert body 250 that defines a passage 254 that extends longitudinally through the body 250. The insert body 250 is substantially cylindrical and defines an outer surface 257 that curves radially inward as the body 250 extends distally. Therefore, the passage 254 may define a proximal diameter $I_P$ between about 1.375 inches and about 1.625 inches, and a distal diameter $I_D$ between about 1 inch and about 1.25 inches. A standard insert 64 may define a proximal diameter $I_P$ of about 1.5 inches, and a distal diameter $I_D$ of about 1.125 inches. It should be understood, however, that the insert 64 may include any proximal diameter $I_P$ and distal diameter $I_D$ as desired.

The insert 64 is configured to be disposed within the bore 124 of the housing 60. The insert 64 is configured to be disposed within the bore 124 of the housing 60 such that the insert 64 is capable of rotating relative to the housing 60. Therefore, when the pool jet fitting 14 is coupled to the wall mount 50, the insert 64 can be rotated so as to position the insert such that the passage 254 of the insert 64 is directed or otherwise extending towards the pool surface. Water flow from the water pump 28 will then be directed to the surface of the pool to create the desired agitation.

The passage 254 of the insert 64 may be sized to receive the valve 68 such that the valve 68 rotates along with the rotatable insert 64, when the rotatable insert 64 is rotated. Therefore, the adjustable opening 160 of the valve 68 can face the surface of the pool 12 when the insert 64 is rotated to face the surface of the pool 12.

Referring to FIGS. 1A and 9A-9C, the cap 72 is configured to be coupled to the housing 60 to thereby hold the insert 64 and the valve 68 within the housing 60. The cap 72 includes a substantially cylindrical cap body 252 that defines a bore 256 that extends longitudinally through the body 252. The cap 72 further includes a coupler, such as internal threads 258 that extend out from an internal surface 262 of the bore 256. The threads 258 are configured to engage the threads 140 of the housing 60 to thereby releasably affix the cap 72 to the distal end of the housing 60 and retain the insert 64 and the valve 68 within the housing 60. It should be understood, however, that the cap 72 is not limited to threads 258, and that the cap 72 may include any coupler that is capable of releasably coupling the cap 72 to the housing 60.

Figure 9A:
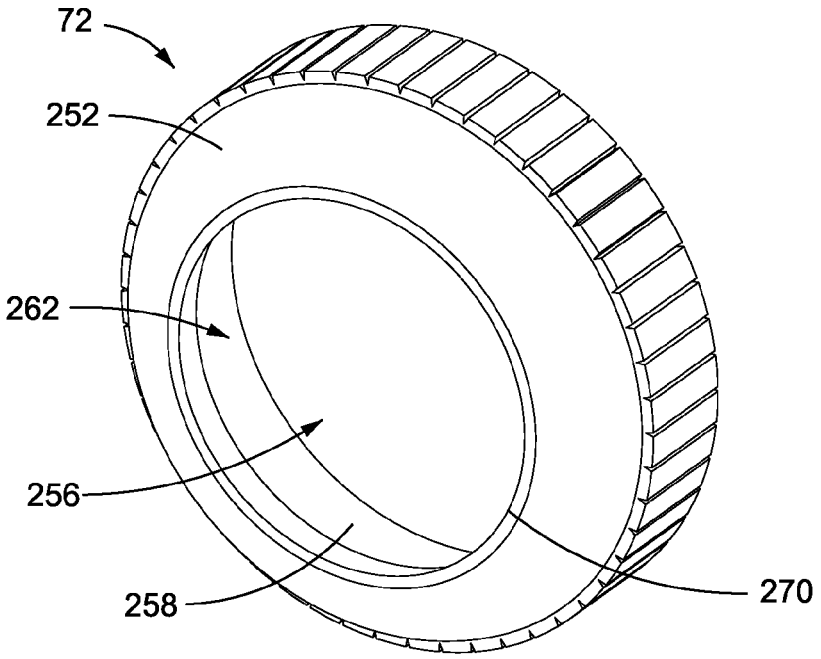
FIG. 9A is a perspective view of the cap shown in FIG. 2A.
Figure 9B:
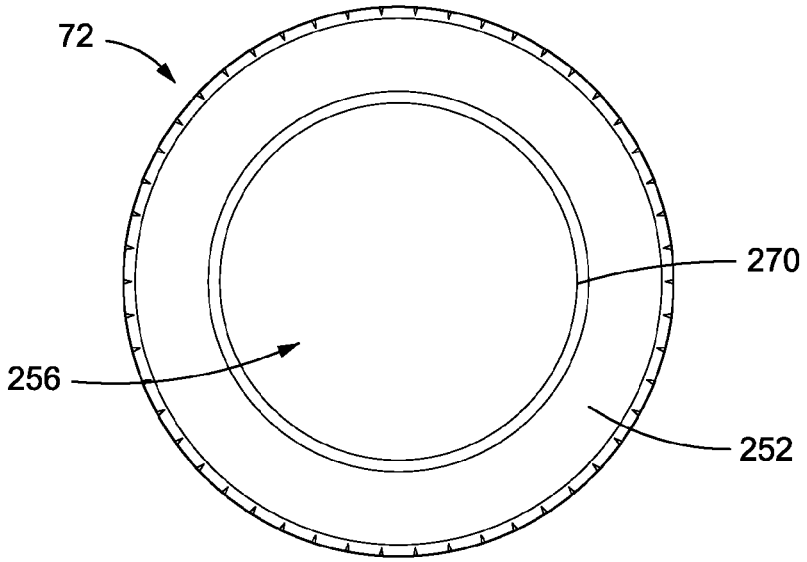
FIG. 9B is a front elevation view of the cap shown in FIG. 9A.
Figure 9C:
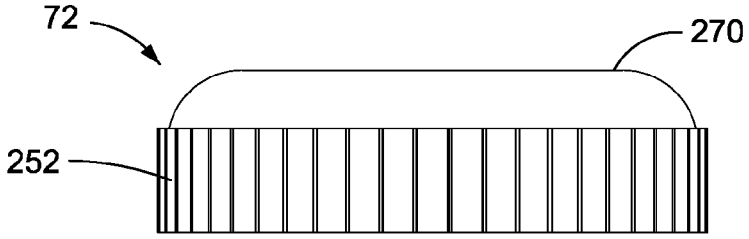
FIG. 9C is a side elevation view of the cap shown in FIG. 9A.

Referring to FIGS. 2A and 9A, the cap 72 bore 256 extends through the cap body 252 and terminates at an opening 270 defined by a distal end of the cap body 252. The opening 270 includes a diameter that is less than the diameter of the bore 256. As shown in FIG. 2A, a portion of the rotatable insert 64 extends through the opening 270 when the cap 72 is coupled to the housing 60. Therefore, the insert 64 may be rotated while the pool jet fitting 14 is completely assembly and coupled to the wall mount 50.

In operation the pool jet fitting 14 will capable of maintaining a desired surface agitation whether the water pump 28 is operating at high speeds or at low speeds. For example, when the water pump 28 is operating at high speeds the water flow from the pump will be at a high velocity. As the high velocity water flow passes through the valve 68, the members 168 will flex outward thereby increasing the diameter and thus the area of the adjustable opening 160 of the valve 68. When the water pump 28 is changed from operating at high speeds to operating at low speeds the water flow from the pump 28 will decrease to a lower velocity as compared to when the pump is operating at high speeds. As the low velocity water flow passes through the valve 68, the members 168 will return to their non-flexed state thereby decreasing the diameter and thus the area of the adjustable opening 160 of the valve 68. Because the opening 160 has a smaller diameter when the pump 28 is operating at low speeds, the outflow velocity of the water will be increased to thereby maintain an outflow velocity that agitates the surface of the pool. Therefore, the pool jet fitting 14 will maintain a substantially similar outflow velocity, or at least maintain an outflow velocity within a specified range that agitates the surface of the pool whether the pump 28 is operating at high speeds or at low speeds.

Figure 10:
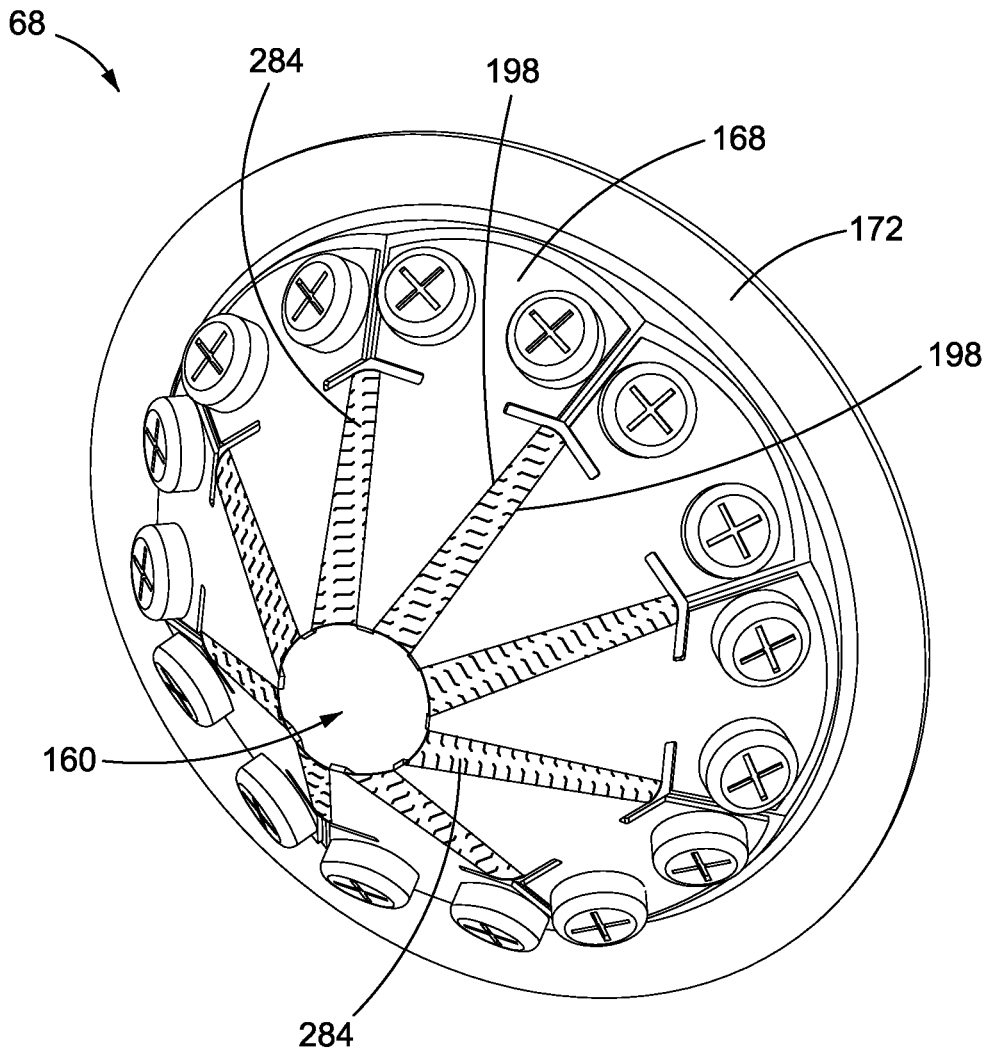
FIG. 10 is a perspective view of a valve in accordance with another embodiment, the valve including a plurality of extendable sections, each extendable section being coupled to a pair of adjacent members.

In another embodiment, and in reference to FIG. 10, the valve 68 may include a plurality of extendable sections 284, each extendable section being coupled to a pair of adjacent members 168. The extendable sections 284 are configured to expand as the members 168 flex outwardly to thereby cover any gaps formed between adjacent members 168 when the members 168 have fully flexed. By covering the gaps, the outflow velocity of the water through the valve 68 may be more easily controlled. That is, when the valve 68 includes the extendable sections 284, the water flow only exits the adjustable opening 160 whether the members are flexed or not. The extendable sections 284 may be made from any material capable of expanding. For example, the extendable sections 284 may be made from a rubber, a cloth-like material, or even be structured like an accordion.

As shown, the extendable sections 284 are coupled to the outer sides 198 of the members 168. It should be understood, however, that the extendable sections 284 may be coupled to any part of the members 168. For example, the extendable members 284 may each define a sleeve that is coupled to the members 168 by being wrapped around the members 168. Moreover, the extendable sections 284 may be separate components from the members 168 or the members 168 and the extendable sections 284 may be integrally formed.

Figure 11:
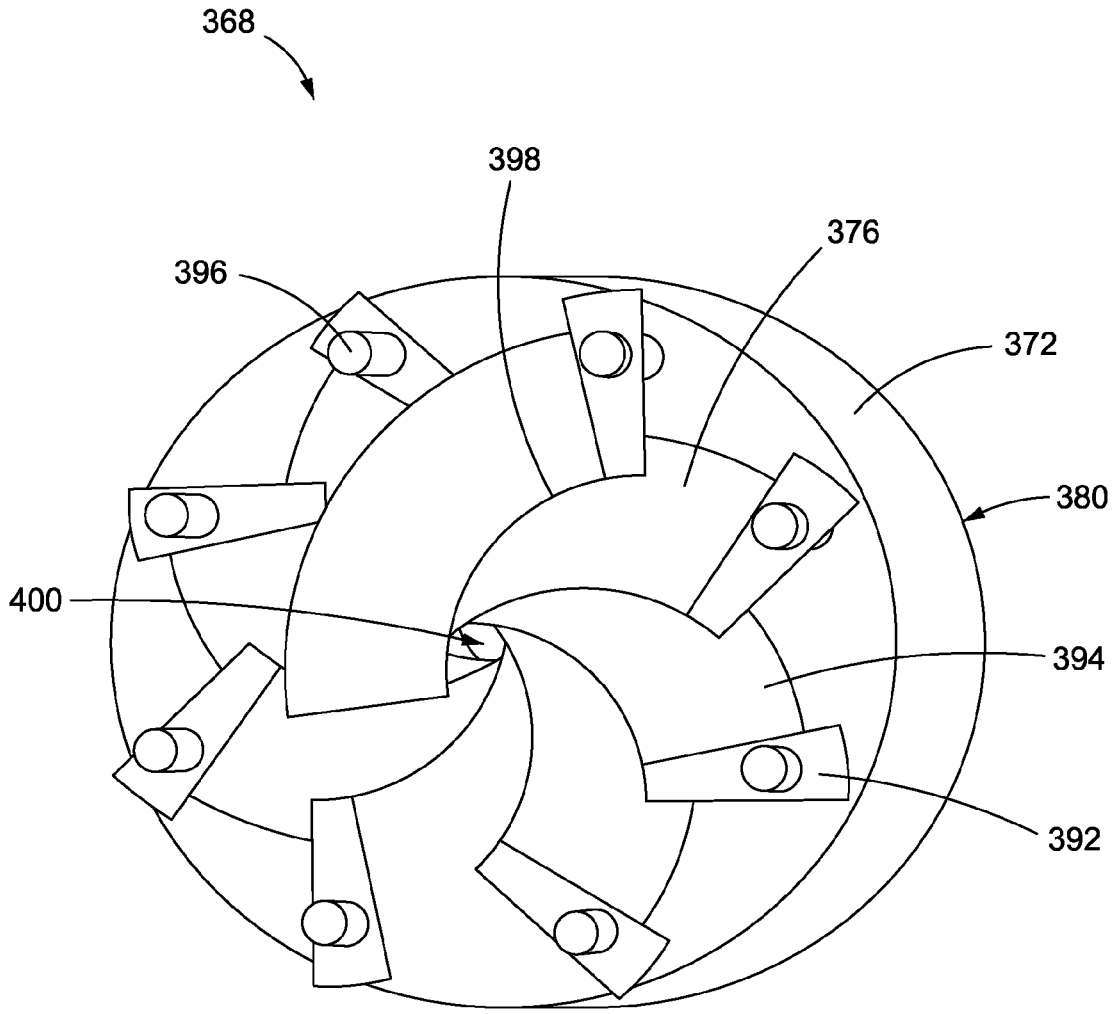
FIG. 11 is a schematic of a valve in accordance with another embodiment, the valve including a valve body and a plurality of members that are configured to rotate and lift when the pool jet fitting receives a high velocity of water flow from the water pump.

In another embodiment, and in reference to FIG. 11, the pool jet fitting 14 may include a valve 368 having a valve body 372 and a plurality of members 376 that are rotatably coupled to the valve body 372. The members 376 are configured to flex and rotate relative to the valve body 372 as the water flow from the water pump increases in velocity. The valve body 372 is substantially cylindrical and defines a bore 380 that extends longitudinally through the body 372.

As shown in FIG. 11, each member 376 is substantially curved and includes a coupling portion 392, and a flexing portion 394 that extends distally from the coupling portion 392. The coupling portion 392 is coupled to the body 372 with a fixation element, such as a peg 396 such that that member 376 is capable of rotating about the peg 396. The members 376 are coupled to the body 372 such that the members 376 surround the bore 380. The flexing portion 394 defines a curved inner surface 398. As shown, the curved inner surfaces 398 of the members 376 together define an adjustable opening 400 through which the water flow may pass.

As shown in FIG. 11, each member 376 further includes a hinge that couples the flexing portion 394 to the coupling portion 392. As water flow through the valve 368 increases, the members 376 will rotate about their pegs 396 and their flexing portions 394 will flex outwardly. As the members 376 rotate and the flexing portions 394 flex, a dimension (i.e. diameter) of the adjustable opening 400 will increase. Therefore, similar to the valve 68 shown in FIGS. 5A-5D, the valve 368 is capable of maintaining the outflow velocity of the pool jet fitting 14 whether the water pump 28 is operating at high speeds or at low speeds.

Figure 12:
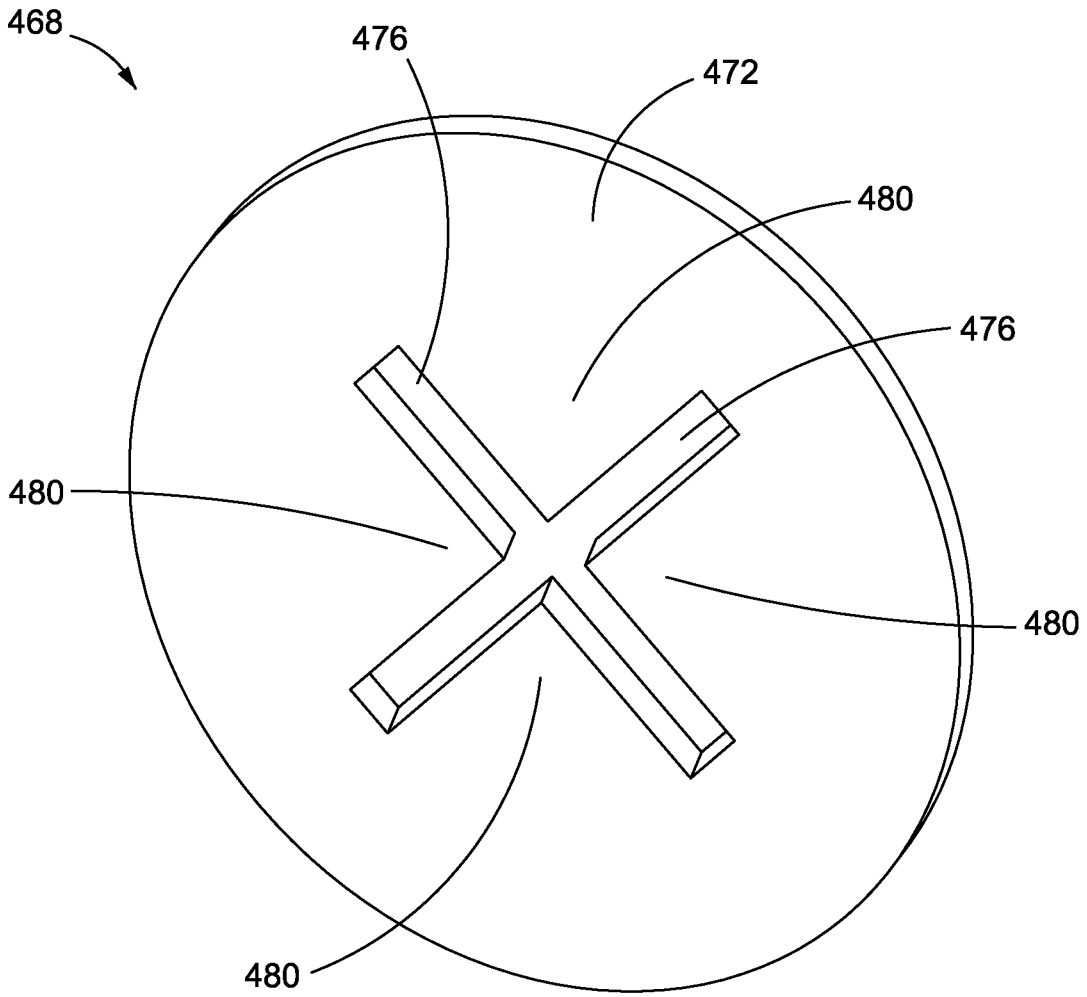
FIG. 12 is a perspective view of a valve in accordance with another embodiment, the valve including a valve body having at least two slots that define at least four flexible portions.

In another embodiment and in reference to FIG. 12, the pool jet fitting 14 may include a valve 468 having a valve body 472 that is capable of being positioned in the bore of the housing. The valve 468 includes at least one, such as two slits 476 that define at least two, such as four flexible members 480. In the illustrated embodiment, the valve 468 includes two slits that are in a cross-like configuration and define four wedge shaped flexible members 480, though it should be understood that any configuration may be desired. For example, the slits 476 may define a T-shaped, or Y-shaped configuration. As with the valve 68, the flexible members 480 are configured to flex outwardly as water flows through the valve 468. As the water flow to the valve 468 increases, the flexible members 480 flex outwardly so as to facilitate the predetermined outflow velocity of the water received from the water pump.

It should be understood that while the pool filter system 10 has been described as utilizing a variable speed water pump 28, it should be understood that the pool filter system 10 may utilize a single speed water pump 28. For example, because in certain cases the piping used to operatively couple the pool jet fittings 14 to the water pump 28 vary with respect to each pool jet fitting 14, the amount of or flow of water from the water pump 28 may vary with respect to each pool jet fitting 14. Therefore, by using the pool jet fittings 14 that include valves with adjustable openings, the outflow velocity from each pool jet fitting 14 may be substantially similar or at least within a desired range. Moreover, it should be understood that every pool jet fitting of the system 10 does not have to be a pool jet fitting 14 having an adjustable opening. Therefore, the pool filter system 10 may include some pool jet fittings 14 having an adjustable opening, and at least one non-adjustable pool jet fitting having a fixed opening.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed:

1. A pool jet fitting configured to direct flow of water, the pool jet fitting comprising:

a housing including a housing body and a bore that extends through the housing body along a central axis, the housing body including a coupler that is configured to be releasably coupled to a wall mount, the bore configured to receive a flow of water from a water pump when the housing is coupled to the wall mount and the water pump pumps the water flow; and a valve positioned in the bore of the housing, the valve defining an adjustable opening configured to permit the flow of water to pass therethrough, the adjustable opening defining a dimension that is centered along the central axis and is unobstructed along an entirety of the dimension so that water is flowable therethrough, and the adjustable opening is capable of automatically adjusting between a first dimension and a second dimension so as to facilitate a predetermined outflow velocity of the water from the valve received from the pump, wherein the adjustable opening is unobstructed in the first dimension and the second dimension so as to permit the flow of water to pass therethrough.

2. The pool jet fitting according to claim 1, wherein the predetermined outflow velocity is a range of velocities.

3. The pool jet fitting according to claim 1, whereby the predetermined outflow velocity corresponds to a minimum velocity at which the water flow through the valve is visible on the surface of the pool.

4. The pool jet fitting according to claim 1, wherein the dimension of the adjustable opening is capable of automatically adjusting in response to a change in water pump output.

5. The pool jet fitting according to claim 2, wherein (i) the water pump is a variable flow water pump that is capable of pumping the water at different flow rates, and (ii) the predetermined outflow velocity is maintained within a predetermined range of velocities as the flow rate of the variable flow water pump changes.

6. The pool jet fitting according to claim 1, wherein the wall mount is a pre-existing wall mount of a pre-existing pool.

7. The pool jet fitting according to claim 1, wherein the first dimension is about 0.25 inches and the second dimension is about 1.25 inches.

8. The pool jet fitting according to claim 1, wherein the valve includes a valve body and at least one flexible member that extends distally relative to the valve body, the at least one flexible member defining a distal end that defines the adjustable opening.

9. The pool jet fitting according to claim 8, wherein the at least one flexible member is configured to flex outwardly to thereby increase the dimension of the adjustable opening.

10. The pool jet fitting according to claim 9, wherein the at least one flexible member includes a coupling portion that is coupled to the valve body, and a flexing portion that is attached to the coupling portion by a hinge.

11. The pool jet fitting according to claim 10, wherein the coupling portion, the flexing portion, and the hinge of each member are integrally formed as a single unit.

12. The pool jet fitting according to claim 8, wherein each member is substantially triangular in shape.

13. The pool jet fitting according to claim 8, wherein the valve further includes a plurality of extendable sections, each extendable section being coupled to a respective pair of adjacent members of the plurality of members.

14. The pool jet fitting according to claim 1, further comprising a cap that is configured to be attached to the housing to thereby retain the valve in the bore of the housing.

15. The pool jet fitting according to claim 1, further comprising a rotatable insert positioned within the bore of the housing, the rotatable insert defining a passage configured to direct the flow of water, wherein the valve is positioned within the passage of the rotatable insert such that the valve rotates along with the rotatable insert, when the rotatable insert is rotated.

16. The pool jet fitting according to claim 15, wherein the passage of the rotatable insert has a diameter of about 1.5 inches.

17. The pool jet fitting according to claim 1, wherein the housing has a length between about 0.875 inches and about 1.125 inches, and a diameter between about 1.75 inches and about 2.0 inches.

18. The pool jet fitting according to claim 1, wherein the valve defines an inner surface and an opposed outer surface, wherein impingement of the flow of water against the inner surface of the valve causes the adjustable opening to increase from the first dimension to the second dimension along a direction that is perpendicular to the central axis.

19. A pool jet fitting configured to direct a flow of water from a variable flow water pump configured to pump the water at different flow rates into a pool, the pool jet fitting comprising:

a valve configured to receive the flow of water flow the variable flow water pump when the valve is disposed in line with the variable flow water pump, the valve including an input end and an output end spaced from the input end along a central axis in a first direction, the valve including a valve body, a plurality of flexible members that extend from the valve body and that converge toward a central axis, and an adjustable opening disposed at the output end, each flexible member including a proximal end disposed at the valve body, and a distal end opposed to the proximal end, each distal end being spaced apart from the central axis along a second direction that is perpendicular to the central axis so as to define the adjustable opening, the adjustable opening defining a dimension that extends along the second direction, and an entirety of the adjustable opening is unobstructed so as to permit water to flow through the valve, wherein the valve is configured such that water impinging the plurality of flexible members in the first direction adjusts the dimension of the adjustable opening between a first dimension and a second dimension that is greater than the first dimension so as to maintain a predetermined outflow velocity of the water as the flow rate of the water flow from the variable speed water pump changes.

20. The pool jet fitting according to claim 19, wherein the adjustable opening defines a dimension that is centered about the central axis and is capable of automatically increasing from a nonzero first dimension to a second dimension that is greater than the first dimension.

21. The pool jet fitting according to claim 20, wherein the dimension extends along the second direction from a first distal end of a first one of the plurality of flexible members to a second distal end of a second one of the plurality of flexible members that is opposite to the first one of the plurality of flexible members.

22. The pool jet fitting according to claim 19, wherein the flexible members include an inner surface and an opposed outer surface, wherein the plurality of flexible members are configured to flex in response to impingement of the flow of water on the inner surfaces, such that when the flow rate of the water flow from the water pump increases, the flexible members flex outwardly away from the central axis to thereby increase the dimension of the adjustable opening.

23. The pool jet fitting according to claim 19, wherein the valve further includes a plurality of extendable sections, each extendable section being coupled to a respective pair of adjacent members of the plurality of members.

24. The pool jet fitting according to claim 19, further comprising a cap that is configured to be attached to the housing.

25. The pool jet fitting according to claim 19, further comprising a rotatable insert positioned within the bore of the housing, the rotatable insert defining a passage configured to direct the water flow, wherein the valve is positioned within the passage of the rotatable insert such that the valve rotates along with the rotatable insert, when the rotatable insert is rotated.

26. The pool jet fitting according to claim 25, wherein the passage of the rotatable insert has a diameter of about 1.5 inches.

27. The pool jet fitting according to claim 19, wherein the housing has a length between about 0.875 inches and about 1.125 inches, and a diameter between about 1.75 inches and about 2.0 inches.

28. The pool jet fitting according to claim 19, wherein the predetermined outflow velocity is a range of velocities.

29. The pool jet fitting according to claim 19, further comprising a housing including a body a bore that extends through the body along the central axis, the housing body configured to be coupled to a wall mount, the valve configured to be disposed in the bore.

* * * * *